US007927468B2

(12) United States Patent
Song et al.

(10) Patent No.: US 7,927,468 B2
(45) Date of Patent: Apr. 19, 2011

(54) ELECTRODE ASSEMBLY FOR USE IN AN ELECTRODEPOSITION PROCESS

(75) Inventors: Guangling Song, Rochester Hills, MI (US); Yar-Ming Wang, Rochester Hills, MI (US); Hong-Hsiang Kuo, Troy, MI (US); Kevin M. Cunningham, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 332 days.

(21) Appl. No.: 12/199,122

(22) Filed: Aug. 27, 2008

(65) Prior Publication Data

US 2010/0051452 A1 Mar. 4, 2010

(51) Int. Cl.
*C25D 17/12* (2006.01)

(52) U.S. Cl. ..... 204/224 R; 204/225; 204/242; 204/275.1; 204/278; 204/280; 204/289; 205/118; 205/122; 205/123; 205/133; 205/134; 205/136; 205/149; 205/151; 205/152

(58) Field of Classification Search ..... 204/243 R, 204/224 R, 280, 225, 275.1, 278, 242, 289; 205/123, 118, 122, 133, 134, 136, 149, 151, 205/152
See application file for complete search history.

(56) References Cited

U.S. PATENT DOCUMENTS 6,143,155 A * 11/2000 Adams et al. ..... 205/87

FOREIGN PATENT DOCUMENTS

JP 56075597 6/1981

* cited by examiner

*Primary Examiner* — Bruce F Bell
(74) *Attorney, Agent, or Firm* — Lionel D. Anderson; Reising Ethington P.C.

(57) ABSTRACT

An electrode assembly for use with an electrodeposition process. According to an exemplary embodiment, the electrode assembly includes an electrode for exchanging electrical current with a solution, a passageway for removing gas that becomes trapped between a workpiece and the solution, and a sleeve for electrically isolating the electrode from the workpiece.

19 Claims, 1 Drawing Sheet

ELECTRODE ASSEMBLY FOR USE IN AN ELECTRODEPOSITION PROCESS

TECHNICAL FIELD

The present invention generally relates to equipment used in an electrodeposition process and, more particularly, to an electrode assembly that is used to electrify a solution or bath so that material can be deposited on a workpiece.

BACKGROUND

The term "electrodeposition" broadly refers to any process that uses electrical current in a solution or bath in order to adhere material to a workpiece surface. In a typical electrodeposition process, an electrically charged workpiece is submerged in an electrolytic solution along with an oppositely charged electrode; this creates electrical current that flows through the solution between the workpiece and the electrode. The solution undergoes an electrochemical process which results in components of the solution being adhered to a workpiece surface. As a final step, the workpiece may be taken out of the solution, rinsed, and then cured. It should be appreciated that an electrodeposition process could include both cathodic and anodic processes such as electrocoating (E-coating), electroplating, as well as any other suitable process for adhering primer, paint, films, metallic coatings, etc. to a workpiece surface.

SUMMARY OF THE INVENTION

According to one embodiment, there is provided an electrode assembly for use in an electrodeposition process. The electrode assembly may include an electrode that exchanges electrical current with a solution, and a passageway that extends with the electrode and includes one or more openings. During the electrodeposition process, gas that is trapped between the solution and a workpiece can escape through the opening and travel within the passageway.

According to another embodiment, there is provided an electrodeposition process that comprises the following steps: (a) bringing an electrode assembly into contact with a solution, wherein the electrode assembly includes an electrode and a passageway with at least one opening; (b) locating the opening in a space that is formed between a surface of a workpiece and the solution; (c) removing gas from the space through the opening and the passageway; and (d) providing an electrical current that causes components of the solution to be deposited on the workpiece.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The electrode assembly described herein may be used in an electrodeposition process in order to improve the distribution and adherence of material to a workpiece surface. One factor that can prohibit material from being optimally deposited on a workpiece involves gas that becomes trapped between the workpiece and the solution. The trapped gas prevents portions of the workpiece surface from coming into contact with the solution; this, in turn, prevents those areas of the workpiece surface from being painted, plated, coated, etc. The electrode assembly described below includes a passageway that removes the trapped gas in order to increase the amount of workpiece surface area that comes into contact with solution. Although the following description is provided in the context of an exemplary automotive application using an electrocoat or E-coat process, it should be appreciated that the electrode assembly could be used in other electrodeposition processes known in the art.

Figure 1:
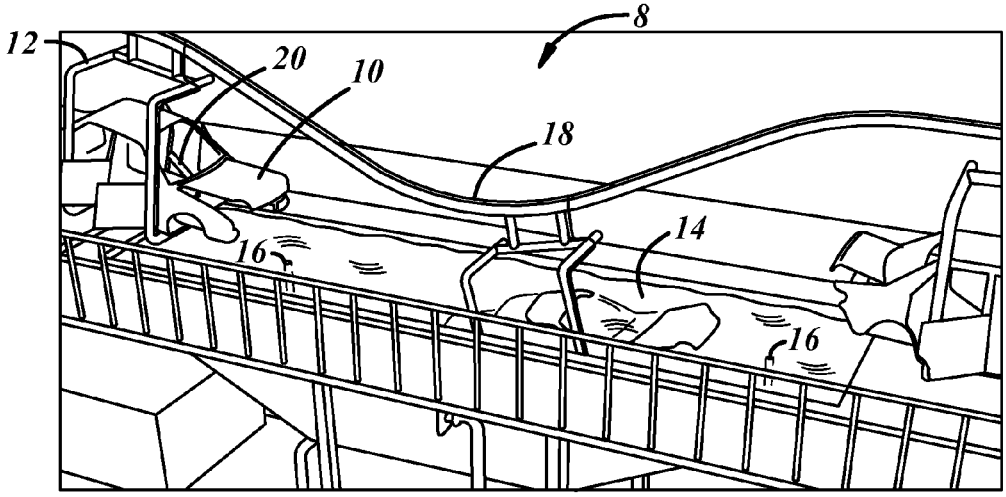
FIG. 1 is a perspective view of an exemplary electrodeposition process where a vehicle body is being dipped into a solution or bath.

With reference to FIG. 1, there is shown an exemplary electrodeposition system 8, such as that commonly used in the automotive industry to adhere primer or paint to the surface of a workpiece 10 such as an automobile body. According to this particular embodiment, an automated workpiece holder 12 carries workpiece 10 into an electrolytic solution or bath 14 so that the body is both physically maintained and electrically charged. One or more stationary electrodes 16 are also located in solution 14 and carry an electrical charge that is opposite to that of workpiece 10 (in some embodiments, a metallic vessel or container that retains solution 14 may also act as a stationary electrode and carry electrical charge opposite of workpiece 10). This creates a potential drop across solution 14 which causes electrical current to flow through the solution and ionic material in the solution to be deposited on workpiece 10. If air pockets form between workpiece 10 and solution 14, this can inhibit the deposition of material in the corresponding area of the workpiece and result in an unsatisfactory output. One way to address the issue of air pockets is with electrode assembly 20, which is schematically shown in FIG. 1 in the interior of the vehicle body and is described below. It should be appreciated that this illustration is simply a schematic representation of exemplary electrode assembly 20, and that the electrode assembly could be positioned elsewhere with respect to the workpiece.

Figure 2:
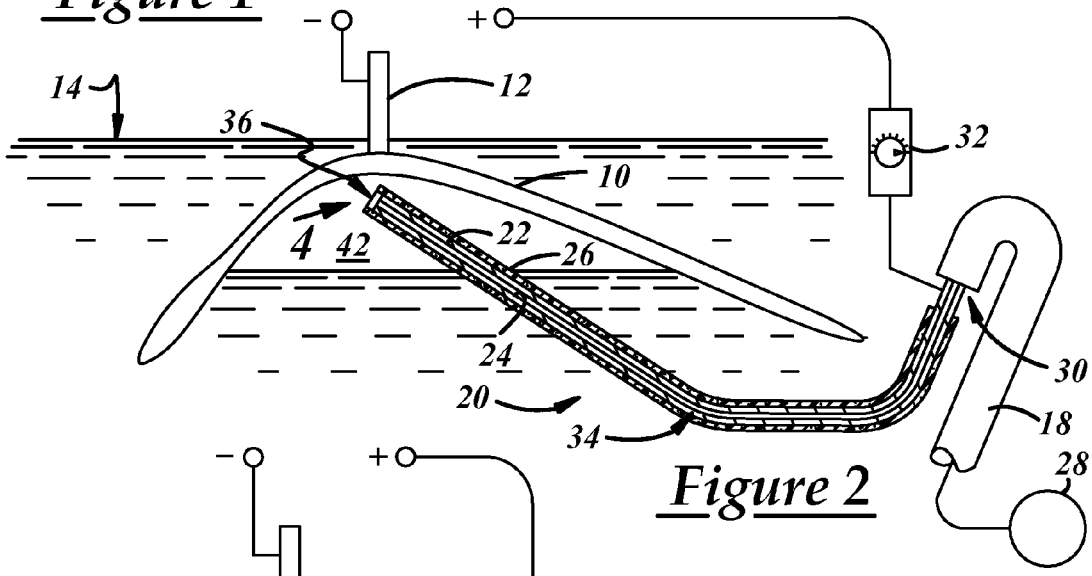
FIG. 2 is a side view of an exemplary electrode assembly that may be used in an electrodeposition process like that of FIG. 1.

Turning now to FIG. 2, there is shown an exemplary embodiment of an electrode assembly 20 that can be used in an electrodeposition process to electrically charge solution 14 and remove gas from undesirable air pockets. According to this particular embodiment, electrode assembly 20 is coupled to workpiece holder 12 such that the electrode assembly travels with the workpiece holder and is therefore stationary with respect to workpiece 10. In such an arrangement, steps should be taken to ensure that electrode assembly 20 and workpiece 10 do not come into physical contact and thus remain electrically isolated from each other, as will be explained. Electrode assembly 20 is preferably positioned at an area where trapped gas is likely to gather, such as underneath a flat, concave, or otherwise contoured section of workpiece 10. For example, electrode assembly 20 could be located underneath portions of the roof, hood, trunk lid, door, fender, to name a few possibilities. According to the exemplary embodiment shown in FIG. 2, electrode assembly 20 includes an electrode 22, a passageway 24, a sleeve 26, and a pump 28. It should be appreciated that the embodiment shown here is only exemplary and that other embodiments, including those having more, less, or different components, could be used.

Electrode 22 is an elongated current carrying member that is coupled to an energy source so that it can exchange electrical current with solution 14 during an electrodeposition process. Electrode 22 can either be charged as an anode (shown in FIG. 2) or as a cathode, depending on the particular electrodeposition setup, and is preferably designed to impart an optimal amount of electrical current in solution 14. Electrode 22 can be made from any suitable conductive or semiconductive material known in the art (for example, a type of stainless steel that is not corroded or dissolved in solution 14 may be used). Electricity applied to electrode 22 may be adjusted or otherwise controlled by a potentiometer 32 or some other voltage and/or current limiting device. According to the embodiment shown here, electrode 22 has an elongated body 34 that begins at a base 30, extends through several bends and elbows, and terminates at a distal or free end 36. This is, of course, only an exemplary and schematic illustration, as electrode 22 could just as easily be made to have another configuration instead.

Passageway 24 extends with electrode 22 and includes at least one opening 38 for gas that becomes trapped between workpiece 10 and solution 14. In the exemplary embodiment of FIGS. 2 and 4, passageway 24 is defined within an interior of electrode 22 and extends between an opening 38 and a pump 28. It should be appreciated that passageway 24 could extend its entire length within electrode 22, it could extend only a portion of its length within the electrode, or it could extend according to some other suitable configuration. For example, passageway 24 could begin at opening 38, extend within the interior of electrode 22 for some distance, and then exit the interior of the electrode and continue as a separate tube 18, hose, or other means of conveying fluid, for example. In one embodiment, passageway 24 has a uniform interior diameter of approximately 1-4 mm, however, configurations having non-uniform diameters and other dimensions could be used as well. In some situations, a sleeve-like insert could be located within electrode 22 so that the passageway is not in direct communication with the interior of the electrode. If, for example, the gases or other fluids being evacuated through passageway 24 caused some type of corrosion to the interior of electrode 22, this may be appropriate.

Opening 38 communicates with passageway 24 so that gas trapped between solution 14 and workpiece 10 can escape through the opening and travel within passageway. Opening 38 can be located at one of a number of different locations, and can have one of a number of different configurations. In the embodiment shown in FIGS. 2 and 4, opening 38 is a simple circular orifice and is located at distal or free end 36; this is, however, only one possible arrangement. For instance, the opening could be located at a position spaced away from free end 36, such as on the side of elongated body 34 or elsewhere. It is also possible for passageway 34 to include multiple openings either in addition to or in lieu of exemplary opening 38. Opening 38 may be of the same shape as passageway 34, or it could be of a different shape and/or size. Although not shown, a nonconductive nozzle or fitting could be adapted to free end 36 to facilitate entry of trapped gas and to help prevent direct contact between workpiece 10 and electrode 22, as this would cause a short circuit during the electrodeposition process.

According to another embodiment, the passageway is located outside of the electrode and extends along at least a portion of the electrode length. For example, the passageway could be bounded or defined by a separate tube or hose that runs alongside electrode 22. In such an embodiment, electrode 22 could be a solid piece of conductive material and the passageway could extend within a tube that is attached or secured to the side of the electrode by way of fasteners, clips, ties, etc. Solid and perforated tubes are just two possibilities.

Figure 4:
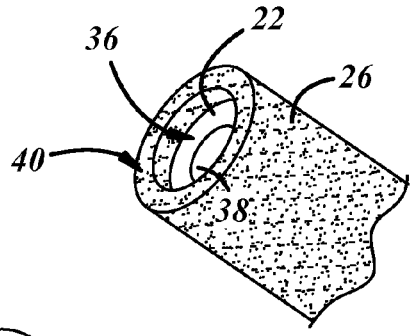
FIG. 4 is an enlarged perspective view of an exemplary free end of the electrode assembly of FIG. 2, taken at arrow 4.

Sleeve 26 surrounds at least a portion of electrode 22 and insulates the electrode from workpiece 10, but still allows electrical current exchange between the electrode and the solution. Sleeve 26 can be made of a porous insulative material that is permeable to gas and liquid such as, but not limited to, a sponge, a meshing material, a plastic netting, or a foam. Still referring to FIGS. 2 and 4, sleeve 26 covers all of an exterior portion of electrode 22 that comes into contact with solution 14. In another example, sleeve 26 may be non-continuous so that it only cover portions of electrode 22 spaced apart along the electrode, and other parts of the electrode are exposed to solution 14. The sleeve material used, the thickness of the sleeve, the length of the sleeve, and other design considerations could be specifically selected in order to influence the current density imparted from electrode 22 to solution 14. Depending on the consistency of solution 14, sleeve 26 may also help prevent a coating or film from forming on electrode 22 itself. As best shown in FIG. 4, sleeve 26 has a free end 40 that protrudes axially beyond the outermost end of passageway 24. This way, if the end of electrode assembly 20 were to come into contact with workpiece 10, free end 40 would prevent direct contact between the workpiece and electrode 22 and thus prevent a short circuit.

Pump 28 communicates with passageway 24 and draws gas and/or solution through opening 38 and the passageway. In some cases, it may be desirable for pump 28 to suck both trapped gas and solution 14 into passageway 24, as this can have a recycling effect on the solution and prevent stagnant pools of paint or other solution from forming. If pump 28 is designed to suck up both trapped gas and solution, then the pump should have some type of output that is in communication with solution 14 so that the liquid solution can be delivered back to the bath. This recirculation helps keep solution 30 agitated within solution bath 14 and may improve the electrodeposition process. In another embodiment, pump 28 could be omitted and passageway 24 could lead to an open area, container, or the like. For example, if the relative pressure difference between the trapped gas and the corresponding atmosphere where the passageway leads to is great enough, then it may not be necessary to actively evacuate the trapped air with a pump. In these cases, the trapped gas will have a greater pressure than that of the atmosphere and will be forced through passageway 24 without the assistance of a pump.

In operation, electrode assembly 20 removes trapped air from underneath workpiece 10 in order to improve the electrodeposition process and obtain a more uniform and desirable coating on the workpiece. The removal of the trapped air could be conducted at the same time that electrode 22 is provided with an electrical charge, or the two steps could be performed sequentially. As workpiece 10 is being submerged in solution 14, gas such as air may be caught or otherwise accumulate in a space 42 formed between the workpiece and the solution. Opening 38 is preferably positioned at the highest point within space 42 where gas might naturally accumulate; however, this is not necessary. In some cases, free end 40 of sleeve 26 may even contact the underside of workpiece 10 to help ensure that the opening is positioned at the highest possible point in order to remove substantially all of the gas. Upon activation, pump 28 sucks gas out of space 42 until the gas is substantially removed and solution 14 fills the void.

Electrical charge can then be applied to electrode 22 so that the surrounding solution becomes electrified and an electrical current is formed. Components of solution 30 are then deposited on, and permanently adhered to, workpiece 10 which is provided with an opposite charge. In the absence of the trapped gas, solution 14 can now contact portions of workpiece 10 where before it could not, and a coating is more evenly applied.

In this context, the exemplary electrode assembly not only improves the electrodeposition process by removing trapped air, but it also provides charge to the electrolytic solution in a region surrounding the part to be coated.

Figure 3:
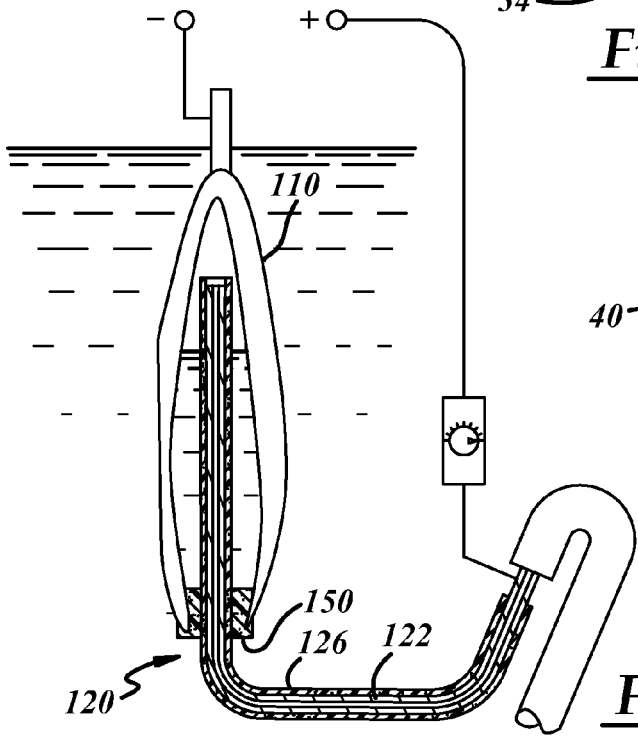
FIG. 3 is a side view of another exemplary electrode assembly that may be used in an electrodeposition process like that of FIG. 1.

FIG. 3 shows another exemplary embodiment of an electrode assembly 120 that is similar to the first embodiment, except that it is adapted to handle workpieces 110 of greater concavity and contour. To help facilitate this, an insulative collar 150 is mounted to an electrode 122 so that it supports workpiece 110 on an electrode assembly 120. Stated differently, collar 150 fits around electrode 122 and a sleeve 126 and enables workpiece 110 to be carried on electrode assembly 120, but does so in a way that electrically isolates the workpiece from the electrode. It is possible for electrode assembly 120 to carry workpiece 110 by itself with a simple electrical connection to the part to keep it charged, or electrode assembly 120 can be used in combination with workpiece holder 12, such as that shown in FIG. 1. Collar 150 can be made of a porous insulative material that is permeable to gas and liquid such as, but not limited to, a meshing, sponge, or foam. This prevents contact between electrode 122 and workpiece 110 but allows the fluidic solution 14 to flow through the collar and to the interior of the workpiece where trapped gas may accumulate. Collar 150 need not be annular in shape, and instead can take other forms and shapes. For example, collar 150 can include one or more appendages that project away from sleeve 126 and attach to workpiece 110 at a terminal end.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the electrode assemblies described above could be used in addition to or in lieu of traditional stationary electrodes that charge an electrolytic solution or bath. It is also possible for the electrode assemblies to be mounted in a stationary way; that is, the above-described electrode assemblies could be mounted to the tank so that they remain fixed as the parts are conveyed. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. An electrode assembly for use in an electrodeposition process involving a solution and a workpiece, comprising:

an electrode that exchanges electrical current with the solution;

a passageway that extends with the electrode and includes at least one opening, wherein during the electrodeposition process gas that is trapped between the solution and the workpiece escapes through the opening and travels within the passageway; and a sleeve surrounding at least a portion of the electrode, wherein the sleeve insulates the electrode from the workpiece, but allows electrical current exchange between the electrode and the solution.

2. The electrode assembly of claim 1, wherein the passageway is located within an interior of the electrode and extends along at least a portion of the electrode length.

3. The electrode assembly of claim 1, wherein the passageway is located outside of the electrode and extends along at least a portion of the electrode length.

4. The electrode assembly of claim 1, wherein the opening is located at a distal end of the electrode and communicates with the passageway.

5. The electrode assembly of claim 1, wherein the opening is located at a position spaced from a distal end of the electrode and communicates with the passageway.

6. The electrode assembly of claim 1, wherein the sleeve is made of a porous meshing material.

7. The electrode assembly of claim 1, further comprising a pump that communicates with the passageway and draws gas trapped between the solution and the workpiece through the opening and the passageway.

8. An electrode assembly for use in an electrodeposition process involving a solution and a workpiece, comprising:

an electrode that exchanges electrical current with the solution;

a passageway that extends with the electrode and includes at least one opening, wherein during the electrodeposition process as that is trapped between the solution and the workpiece escapes through the opening and travels within the passageway; and a collar that is mounted to the electrode and supports the workpiece on the electrode, wherein the collar is made of a material that insulates the electrode from the workpiece.

9. An electrodeposition process, comprising the steps of:

(a) at least partially submerging a workpiece and an electrode assembly in a solution, wherein the electrode assembly includes an electrode and a passageway with at least one opening;

(b) locating the opening of the passageway in a space that is formed between a surface of the workpiece and the solution in which the workpiece is at least partially submerged;

(c) removing gas from the space through the opening and the passageway; and (d) providing an electrical current through the solution in which the workpiece and the electrode assembly are at least partially submerged that causes components of the solution to be deposited on the workpiece.

10. The electrodeposition process of claim 9, wherein the passageway is located within an interior of the electrode and extends along at least a portion of the electrode length.

11. The electrodeposition process of claim 9, wherein the passageway is located outside of the electrode and extends along at least a portion of the electrode length.

12. The electrodeposition process of claim 9, wherein the opening is located at a distal end of the electrode and communicates with the passageway.

13. The electrodeposition process of claim 9, wherein the opening is located at a position spaced from a distal end of the electrode and communicates with the passageway.

14. The electrodeposition process of claim 9, wherein the electrode assembly further includes a sleeve surrounding at least a portion of the electrode, wherein the sleeve is made of a material that insulates the electrode from the workpiece, but allows electrical current exchange between the electrode and the solution.

15. The electrodeposition process of claim 14, wherein the sleeve is made of a porous meshing material.

16. The electrodeposition process of claim 9, wherein step (c) further comprises removing gas from the space by drawing the gas through the opening and the passageway with a pump.

17. The electrodeposition process of claim 9, wherein step (c) further comprises removing gas from the space by relying on a relative pressure difference between the space and the surrounding atmosphere to allow the gas to escape through the opening and the passageway.

18. The electrodeposition process of claim 9, further comprising the step of:

attaching the workpiece to the electrode assembly such that the workpiece is carried by the electrode assembly, wherein this step is performed before step (d).

19. An electrodeposition system for performing an electrodeposition process involving a solution and a workpiece, comprising:

a container holding the solution in which the workpiece is at least partially submerged; and an electrode assembly including an electrode and a passageway, the electrode being at least partially submerged in the solution of the container and exchanging electrical current with the solution, the passageway extending with the electrode and including at least one opening, wherein during the electrodeposition process, gas that is trapped between the solution and the workpiece escapes through the opening and travels within the passageway.

* * * * *